US008607832B2

(12) United States Patent
Ferlito et al.

(10) Patent No.: US 8,607,832 B2
(45) Date of Patent: Dec. 17, 2013

(54) VACUUM PACKAGING IN CONTAINERS PROVIDED WITH AN AIR-TIGHT CLOSING LID

(75) Inventors: Marco Ferlito, Ivrea (IT); Davide Demartini, Forno Canavese (IT); Davide Adriano, Turin (IT); Gabriele Adriano, Turin (IT)

(73) Assignee: F.A.C.E.M. S.p.A., Turin (IT)

( * ) Notice: Subject to any disclaimer, the term of this patent is extended or adjusted under 35 U.S.C. 154(b) by 0 days.

(21) Appl. No.: 12/826,342

(22) Filed: Jun. 29, 2010

(65) Prior Publication Data

US 2010/0326987 A1 Dec. 30, 2010

(30) Foreign Application Priority Data

Jun. 30, 2009 (IT) ..... TO2009A0498

(51) Int. Cl.
*B65B 1/04* (2006.01)
*B65B 31/00* (2006.01)
*B67B 7/86* (2006.01)

(52) U.S. Cl.
CPC ..... *B67B 7/28* (2013.01)
USPC ..... 141/330; 141/65; 53/408; 53/432

(58) Field of Classification Search
USPC ..... 141/65, 7, 8, 66, 329, 330; 220/231, 220/212, 278, 277, 265, 284; 53/79, 88, 53/101, 111 R, 403, 408, 432, 434, 512, 53/428, 510; 215/228, 295, 296, 297, 257; 417/550, 551, 555.1
See application file for complete search history.

(56) References Cited

U.S. PATENT DOCUMENTS

| | | | | | |
|---|---|---|---|---|---|
| 1,518,222 | A | * | 12/1924 | Sather | 81/3.29 |
| 2,182,187 | A | * | 12/1939 | Wagner | 53/512 |
| 2,416,900 | A | | 3/1947 | Busby | |
| 3,255,923 | A | * | 6/1966 | Soto | 222/80 |
| 3,612,722 | A | * | 10/1971 | Neward | 417/63 |
| 4,249,583 | A | * | 2/1981 | Lundbladh | 141/65 |
| 4,278,114 | A | * | 7/1981 | Ruberg | 141/65 |

(Continued)

FOREIGN PATENT DOCUMENTS

| | | | |
|---|---|---|---|
| DE | 10 2007 010029 | A1 | 9/2008 |
| EP | 0 041 225 | A1 | 12/1981 |
| GB | 2 008 200 | A | 5/1979 |
| WO | WO 2005/093303 | A1 | 10/2005 |

OTHER PUBLICATIONS

European Search Report for corresponding European Patent Application No. 10167837.3 dated Aug. 11, 2010.

*Primary Examiner* — Timothy L Maust
(74) *Attorney, Agent, or Firm* — Merchant & Gould P.C.

(57) ABSTRACT

A vacuum seal valve is applied to a lid for the air-tight closing of a container for the packaging of products, particularly food products, including a closing body arranged for sealing a hole for evacuating air from the container, from which at least one punching member stems that is adapted to pierce the lid closing the container so as to form such evacuating hole. A reciprocating mechanical vacuum pump, with manual actuation, evacuates air from a container arranged for the vacuum packaging of products, for example food products, via application of the vacuum sealing valve. The pump has, at its base, a recess adapted to form a housing for retaining the valve, whereby the lowering movement of the plunger allows driving the valve in a lid of the container.

10 Claims, 14 Drawing Sheets

(56) References Cited

U.S. PATENT DOCUMENTS

| | | | | | |
|---|---|---|---|---|---|
| 4,287,819 | A | * | 9/1981 | Emerit | 99/472 |
| 4,412,623 | A | * | 11/1983 | Schmidt | 215/11.1 |
| 4,583,925 | A | * | 4/1986 | Hawkins | 417/555.1 |
| 4,975,028 | A | * | 12/1990 | Schultz | 417/442 |
| 5,010,928 | A | * | 4/1991 | Ballas | 141/64 |
| 5,031,785 | A | * | 7/1991 | Lemme | 215/228 |
| 5,273,171 | A | * | 12/1993 | Steele-Rowland et al. | 215/11.1 |
| 5,299,917 | A | * | 4/1994 | Schultz | 417/238 |
| 5,332,095 | A | * | 7/1994 | Wu | 206/524.8 |
| 5,338,166 | A | * | 8/1994 | Schultz | 417/442 |
| 5,364,241 | A | * | 11/1994 | Schultz | 220/203.11 |
| 5,449,079 | A | * | 9/1995 | Yang | 215/228 |
| 5,450,963 | A | * | 9/1995 | Carson | 206/524.8 |
| 5,469,979 | A | * | 11/1995 | Chiou | 215/228 |
| 5,540,557 | A | * | 7/1996 | Carson | 417/53 |
| 5,662,677 | A | * | 9/1997 | Wimmer | 606/201 |
| 5,818,059 | A | * | 10/1998 | Coyne et al. | 250/507.1 |
| 6,070,397 | A | * | 6/2000 | Bachhuber | 53/512 |
| 7,140,402 | B2 | * | 11/2006 | Russell | 141/65 |
| 7,350,541 | B2 | * | 4/2008 | Kobetsky | 137/854 |
| 7,490,452 | B2 | * | 2/2009 | Alipour et al. | 53/434 |
| 7,614,203 | B2 | * | 11/2009 | Oltrogge | 53/434 |
| 7,805,913 | B2 | * | 10/2010 | Alipour et al. | 53/512 |
| 7,818,948 | B2 | * | 10/2010 | Cannon | 53/434 |
| 7,832,576 | B2 | * | 11/2010 | Cohn | 215/11.3 |
| 2005/0172577 | A1 | * | 8/2005 | Oltrogge | 53/434 |
| 2006/0254219 | A1 | * | 11/2006 | Alipour et al. | 53/434 |
| 2008/0099708 | A1 | * | 5/2008 | Lee | 251/144 |
| 2008/0230144 | A1 | * | 9/2008 | Anderson | 141/65 |
| 2009/0007523 | A1 | * | 1/2009 | Alipour et al. | 53/434 |
| 2009/0026401 | A1 | * | 1/2009 | Dobkins | 251/149.6 |
| 2009/0223174 | A1 | * | 9/2009 | Sargent | 53/434 |
| 2010/0192518 | A1 | * | 8/2010 | Cannon, Jr. | 53/434 |

* cited by examiner

VACUUM PACKAGING IN CONTAINERS PROVIDED WITH AN AIR-TIGHT CLOSING LID

This application claims benefit of TO2009A000498, filed Jun. 30, 2009 in Italy and which application is incorporated herein by reference. To the extent appropriate, a claim of priority is made to each of the above disclosed applications.

FIELD OF THE INVENTION

The present invention generally regards the technology of vacuum packaging, in particular of foods. More particularly, the invention refers to the vacuum packaging of perishable foods or similar products in containers provided with a sealing closure lid.

Specifically, the invention concerns a vacuum sealing valve for application to the lid of a container, and a vacuum pump adapted to suction air and produce reduced pressure in a vacuum system, such as a food container provided with a sealing valve.

BACKGROUND OF THE INVENTION

Containers for the vacuum packaging of food products, or in any case items which are perishable if placed in prolonged contact with the atmosphere, have been known for a number of decades. Among these, the most widespread containers in the domestic field for preserving freshly-prepared foods are the rigid containers of generally cylindrical shape, such as jars or pots made of glass, aluminium or plastic, equipped with a sealing lid for closing the mouth. The containers intended for use for vacuum packaging are industrially produced and comprise a lid provided with a valve or similar vacuum sealing device, adapted to reclose an air evacuation hole previously made during the industrial production of such lids. Attachable to such containers is a common pumping device for sucking air and creating reduced pressure ("the vacuum") therein, e.g. a vacuum packaging machine.

A vacuum sealing device is for example described in the U.S. Pat. No. 2,416,900, and is formed by a valve body housed in a dedicated seat made in a lid arranged for the air-tight and vacuum closure of a jar.

Similar solutions, in which the air evacuation hole is previously made during the industrial production of the container and before the assembly of the valve, are typically used in providing flexible, collapsible containers. Among these, the patent application WO 2005/093303 A1 describes a vacuum sealing device applied to a bag for vacuum packaging foods, which includes a flexible closing body coupled with a valve seat welded by heat-sealing on the border of an evacuation hole made on one face of the bag. The closing body has a sealing diaphragm, adapted to cooperate with a surface of the valve seat surrounding a plurality of radial evacuation openings, in order to ensure the air-tight closure of the container. From the closing body head, there emerges an axial stem whose end, spike-shaped, interferes with a coaxial, annular abutment surface of the sealing device in a manner so as to stably retain the closing body, preventing any translation movement thereof along the stem axis. The diaphragm is flexible and capable of being removed from the surface of the valve seat in an operating suction condition, thus to allow the air evacuation.

A reciprocating mechanical pump, manually actuatable, for sucking air from a receptacle and a multipurpose lid in disc form for closing a mouth of the receptacle and maintaining the reduced pressure created at its interior over time are for example described in the U.S. Pat. No. 5,364,241.

As an alternative to the industrial manufacture of containers equipped with suitable lid for vacuum packaging of the same, artisanal solutions are known for transforming a common air-tight closure jar into a container suitable for vacuum packaging. Such solutions are based on the provision of set of devices, generally comprising a pin or similar tool for punching a jar lid and a plurality of portions of an adhesive film, adapted to be arranged on the surface of the lid at the obtained hole and to allow the air evacuation and subsequent sealing closure of the hole due to the reduced pressure inside the container.

Such solution is at the base of the device known by the commercial name "Pump 'n' Seal" of Pioneering Concepts, Inc.

SUMMARY OF THE INVENTION

The present invention has the object of providing a simplified system for the domestic transformation of an air-tight container into a container for vacuum packaging which is easy to use and has high efficiency, avoiding the disadvantages of the prior art.

In summary, the present invention is based on the principle of combining in a single device the function of punching the container lid, for the creation of an air evacuation hole, and the valve function for evacuating air from the container and for the sealing closure of the same.

The vacuum sealing valve according to the invention is usable in combination with any means for evacuating air from a container, including, for example, a vacuum packaging machine or a manual mechanical pump.

Advantageously, the reciprocating vacuum pump according to the invention adds characteristics to the typical functionalities of a pump of such kind that make it suitable for use with the sealing valves according to the invention.

BRIEF DESCRIPTION OF THE DRAWINGS

Further characteristics and advantages of the invention will be set forth in more detail in the detailed following description given as a non-limiting example with reference to the attached drawings, in which.

In the figures, identical or functionally equivalent elements or components are indicated with the same reference numbers.

DETAILED DESCRIPTION OF THE PREFERRED EMBODIMENTS

Figure 1B:
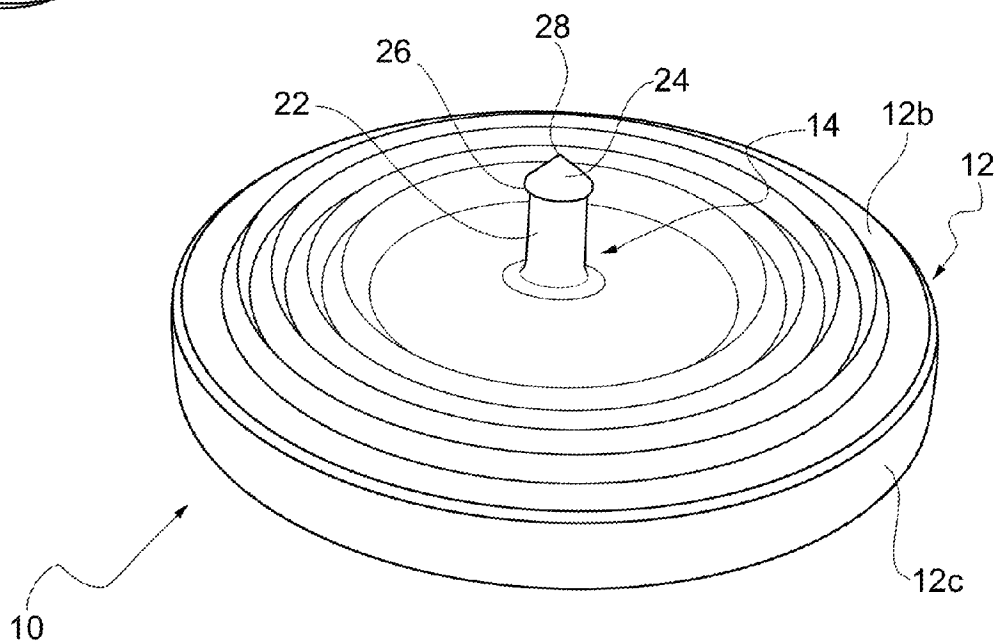
FIGS. 1*a*, 1*b* and 1*c* are perspective and cross section views of a sealing valve of the invention.
Figure 1A:
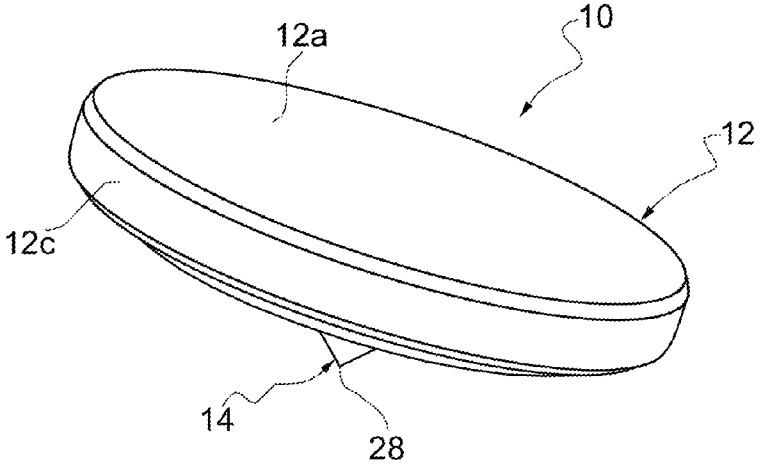
Figure 1C:
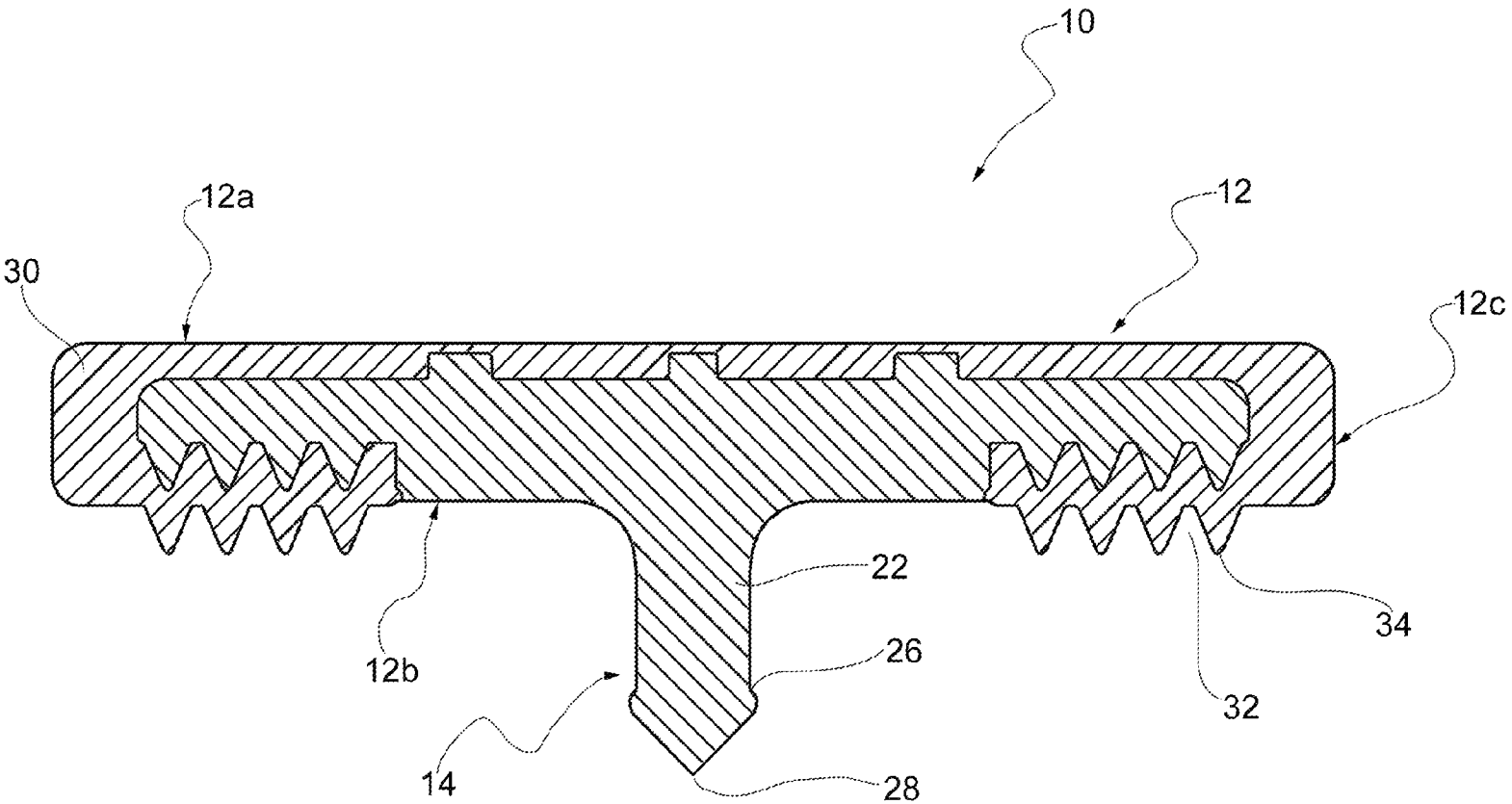

A sealing valve according to the invention for application to a lid of a container with air-tight closing, is generally indicated with the reference number 10 and comprises a disc-shaped closing body 12 and a punching member 14, stemming from the closing member through a stem 22 having at the free end a punching head 24 which projects transversely with respect to the stem so as to define a spiked formation 26 and terminates with a sharp tip 28.

With reference to the use conditions, in the following description with the term "upper face" of the closing body, the surface of the disc will be identified that is turned outside the lid in the assembled condition, indicated with 12*a* in the figures. With the term "lower face", on the other hand, the surface of the disc will be identified that is facing the lid in the assembled condition, indicated with 12*b* in the figures.

The punching member 14 is preferably made of a rigid plastic material. Advantageously, it is made integrally with the closing body of the valve, it too of rigid plastic material, e.g. through a common injection molding or co-molding process, though in an alternative embodiment it could be joined together with the closing body, made of metal or plastic material, via nailing, screwing or co-melting.

Advantageously, the making of the entire valve in plastic material allows considerable material and production cost savings, as well as an increased strength of the same with regard to prolonged use and a lower contamination between the assembled parts.

The valve 10 is arranged for the punching of a conventional lid, e.g. an air-tight lid made of sheet metal material, by driving the tip 28 into the sheet metal of the lid. The air evacuation hole that is thus created also has the function of housing the valve, which is retained by means of the spiked formation 26 adapted to abut onto the edge of the evacuation hole and to consequently prevent the complete extraction of the valve.

The height of the stem 22 defines the possible travel of the valve in its seat, from an air-tight vacuum closure position, in which the closing body is arranged in very close contact with the surface of the lid and closes the air evacuation hole, to an open position, in which the closing body is arranged raised with respect to the surface of the lid in order to allow the passage of the air between the container interior and the outside.

The closing body 12 has a front sealing portion made by a coating 30 made of deformable plastic material, e.g. a material with a high elastic deformation coefficient and a high pneumatic seal, such that it can be shaped on the body of the lid creating an air seal and is also capable of being chemically bonded to the rigid structure plastic part of the valve body, the coating being applied on at least part of the closing body's lower face 12*b*. Preferably, the coating is extended over most of the lower face and on the lateral face, and still more preferably the coating covers the entire closing body 12, also allowing its marking on the upper face 12*a*.

Advantageously, the coating layer is applied on the closing body of plastic material via a co-molding process, which allows directly obtaining, with a single molding step, both the rigid body of the valve and the relative coating. In this case, it is also possible to obtain a chemical bonding of the materials, thus preventing the formation of possible air passages that could damage valve effectiveness.

On the lower face of the valve, the coating 30 is shaped in a manner such to form a succession of grooves 32 and annular ridges 34, concentric with respect to the punching member 14. More generally, the coating forms at least one ridge that extends along a closed path around the punching member, so as to form a gasket adapted to isolate the internal environment of the container, accessible through the air evacuation hole, from the external environment which has a different pressure.

It is observed that the embodiment proposed for the present invention in the preceding discussion is merely exemplifying and non-limiting of the present invention. A man skilled in the art of the field will be able to easily carry out the present invention in different embodiments, which however do not depart from the principles discussed herein, and therefore are comprised in the present patent.

This applies in particular to the possibility of providing the valve with a plurality of punching members, e.g. arranged according to a specific geometric design (as a triangle, square, . . . ). Accordingly, the coating 30 can have gasket conformations extended along a closed path containing all the punching members, or a plurality of gasket paths that are concentric with respect to each punching member.

Figure 2B:
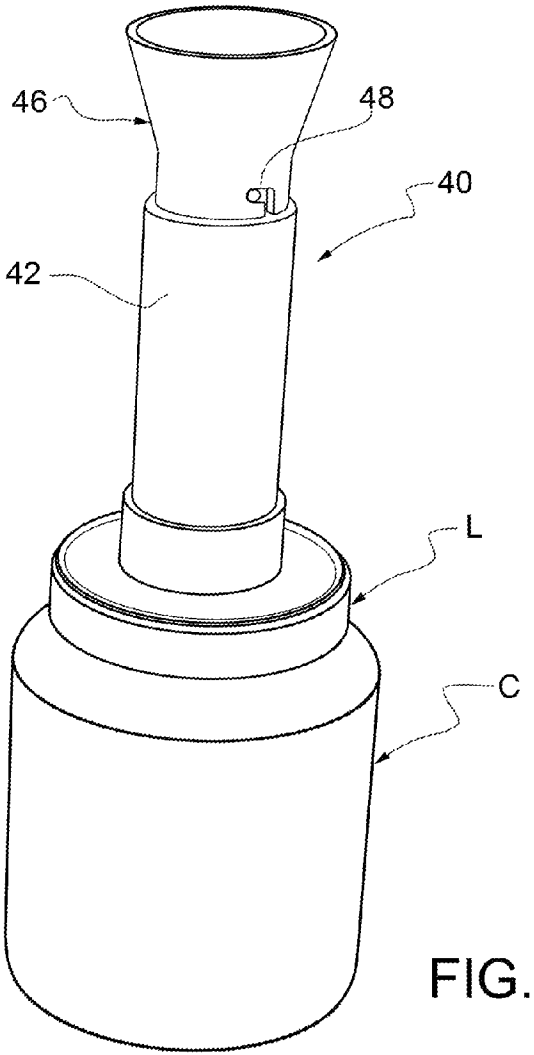
FIGS. 2*a* and 2*b* are overall views of a vacuum packaging system based on the principle of the invention, of the respective component elements separate and assembled and in an operating condition respectively.
Figure 2A:
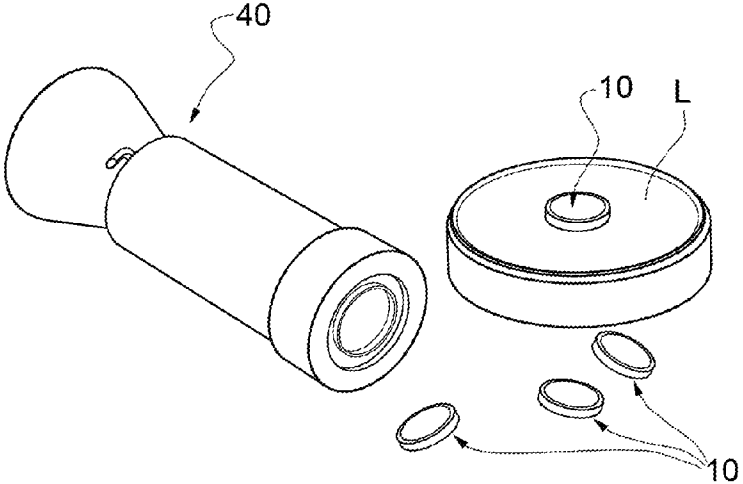

In FIG. 2*a*, a set of parts of a vacuum packaging system is shown according to the principle of the invention.

In detail, a plurality of sealing valves 10 are shown, with one having been previously coupled to a conventional air-tight sheet metal lid L, and a vacuum pump (or suction pump) 40 with manual actuation for creating the vacuum in a container C closed by the air-tight lid L provided with the valve.

In FIG. 2*b*, the vacuum pump 40 associated with the container C is shown in operating suction and vacuum creation condition.

The vacuum pump 40 is a conventional reciprocating mechanical pump, with manual actuation, comprising a plunger slidable with a reciprocating motion into a cylinder. It is adapted to operate—first—the suction of the air from the container C towards a suction chamber delimited by the walls of the cylinder and by the base of the plunger. Secondly, it operates the compression and release of the air suctioned from the aforesaid chamber to the external environment, through an aperture or a suitable outflow valve.

With reference to the figures, and in particular to the section views 3*a*-3*h*, the pump 40 has a cylindrical body 42 open at the base, within which a hollow cylindrical plunger 44 is slidably arranged. Such plunger is extended over the entire length of the cylinder until it emerges at its top, where it is coupled to an actuation grip 46, in the depicted embodiment a grip with generally frustoconical shape, stably coupled to the plunger, e.g. through bayonet coupling means 48.

The inner cavity 50 of the plunger lends itself for being used as a space for storing a stock of unused valves 10.

The plunger has, at its base 52, a recess 54 having shape and size corresponding to the closing body 12 of the valve, which defines a temporary housing for retaining a valve 10 intended to be driven into a lid. Advantageously, the valve to be driven is retained in the housing via simple friction between the coating 30 of the lateral surface of the valve body 12 and the walls of the recess 54.

At the base of the cylinder 42, a support collar 56 integral therewith forms a flange 58 which defines a support surface of the pump 40 on the lid.

The plunger 44 is slidably and sealingly mounted in the cylinder 42, via interposition of a resiliently deformable V-shaped sealing ring 60, having an inner lip 62 fixed to the outer surface of the plunger, in a respective circumferential seat, and a flexible outer lip 64, adapted to take up an open position in contact with the cylinder in a suction step, and a contracted position, closer to the inner lap 62, which brings about the opening of a circumferential outflow aperture 66 between the ring and the cylinder inner wall, in a discharge step.

FIGS. 3*a*-3*h* describe in detail the different installation steps of a valve on the lid L of a container according to the invention, as well as the operations necessary for creating the vacuum in the container provided with such valve.

Figure 3A:
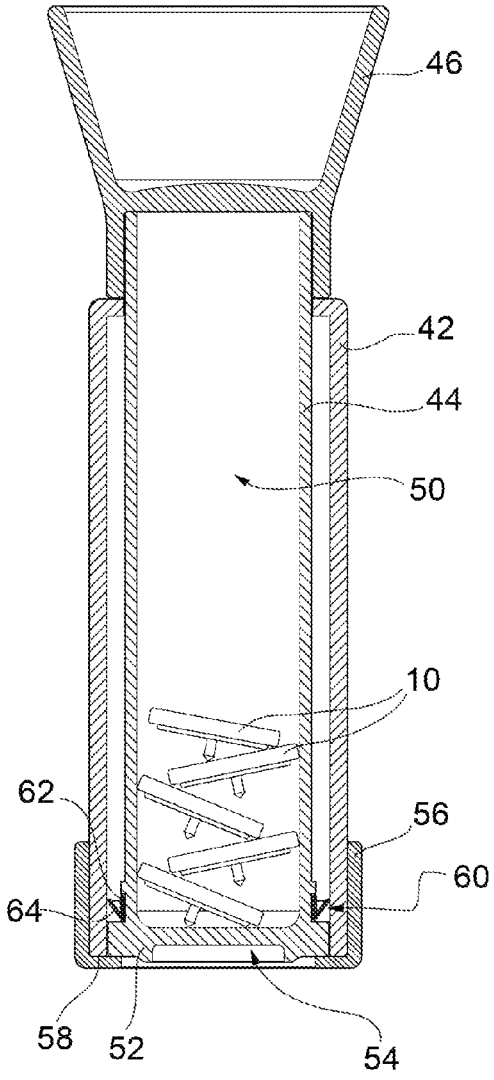
FIGS. 3*a*-3*h* are cross section views representative of the succession of the operating steps of vacuum packaging by means of the system according to the invention.

FIG. 3*a* shows, in a section view, a pump 40 according to the invention in rest condition.

In the space 50, five valves are contained for use with the same number of containers.

Figure 3B:
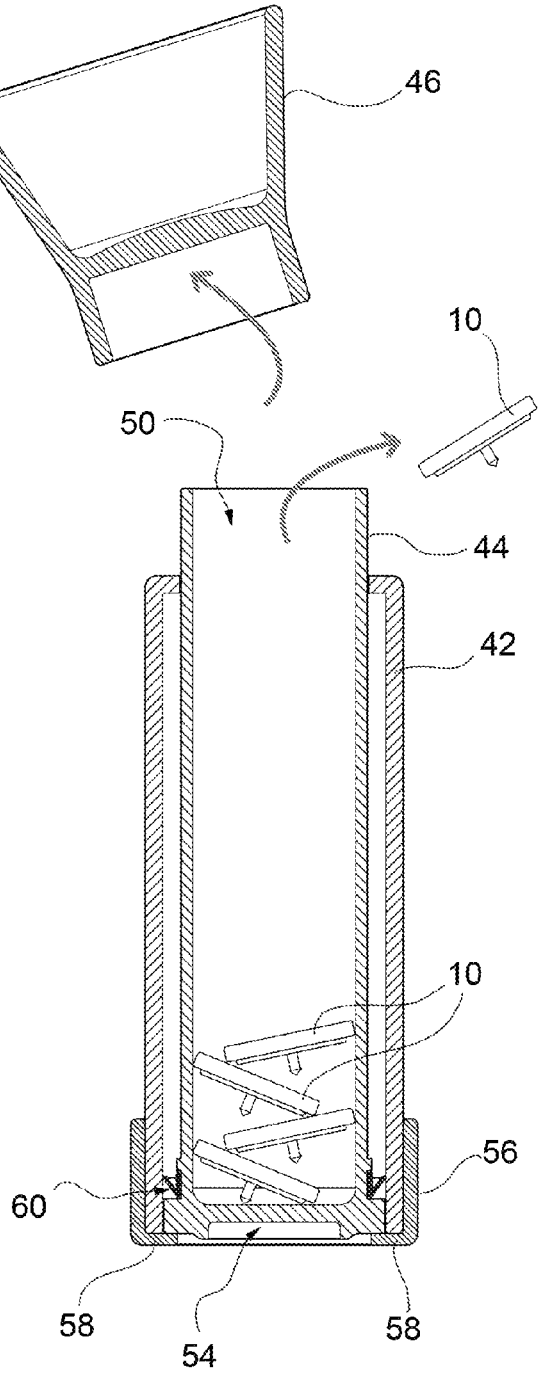
Figure 3C:
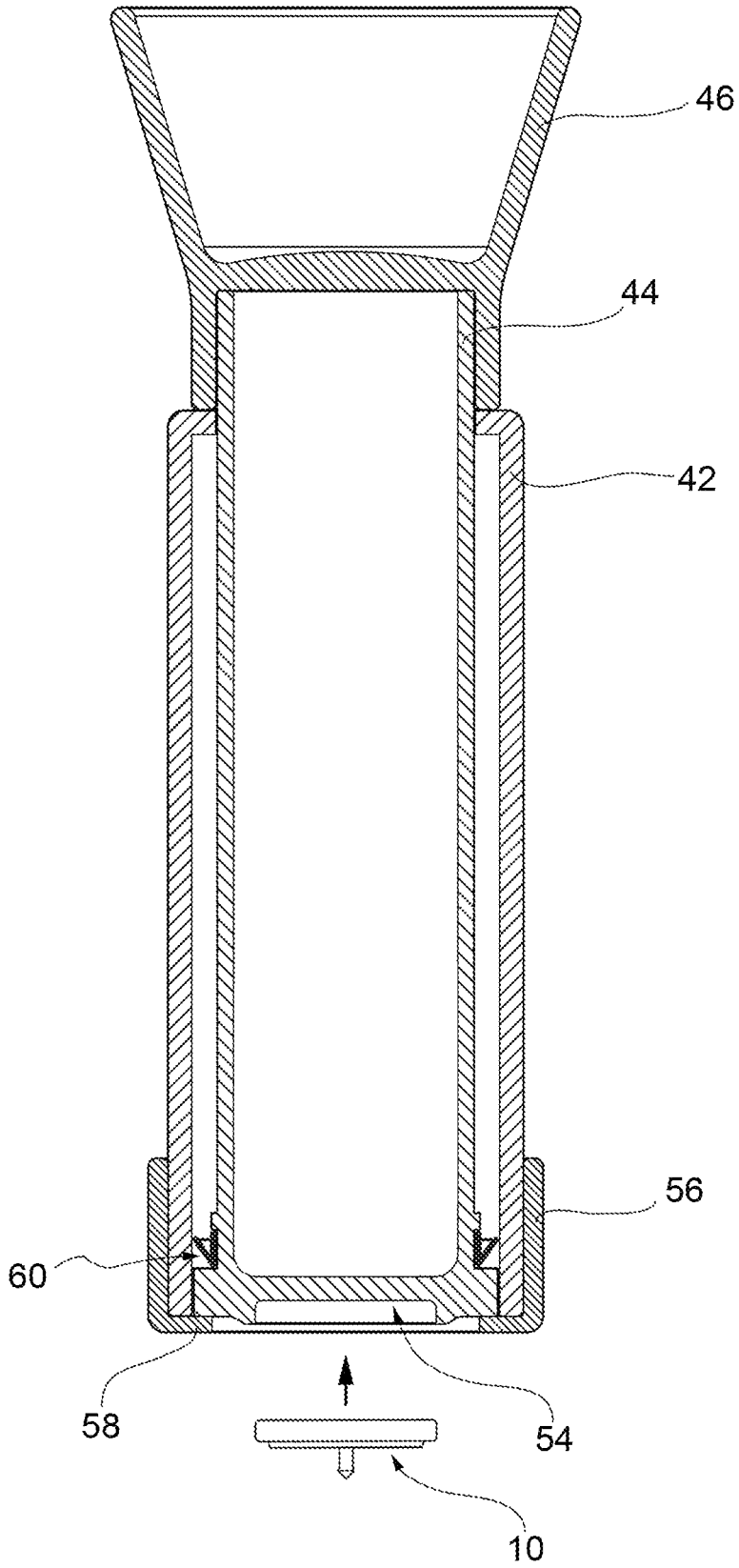

As shown in FIG. 3*b*, by unscrewing or in any case disconnecting the grip 46 from the plunger 44 of the pump, the access to the space is cleared and a valve 10 is extracted. The valve is then manually arranged in the seat 54 (FIG. 3*c*) by exerting a weak pressure in order to overcome the rubbing friction between the coating 30 and the walls of the seat itself.

Figure 3D:
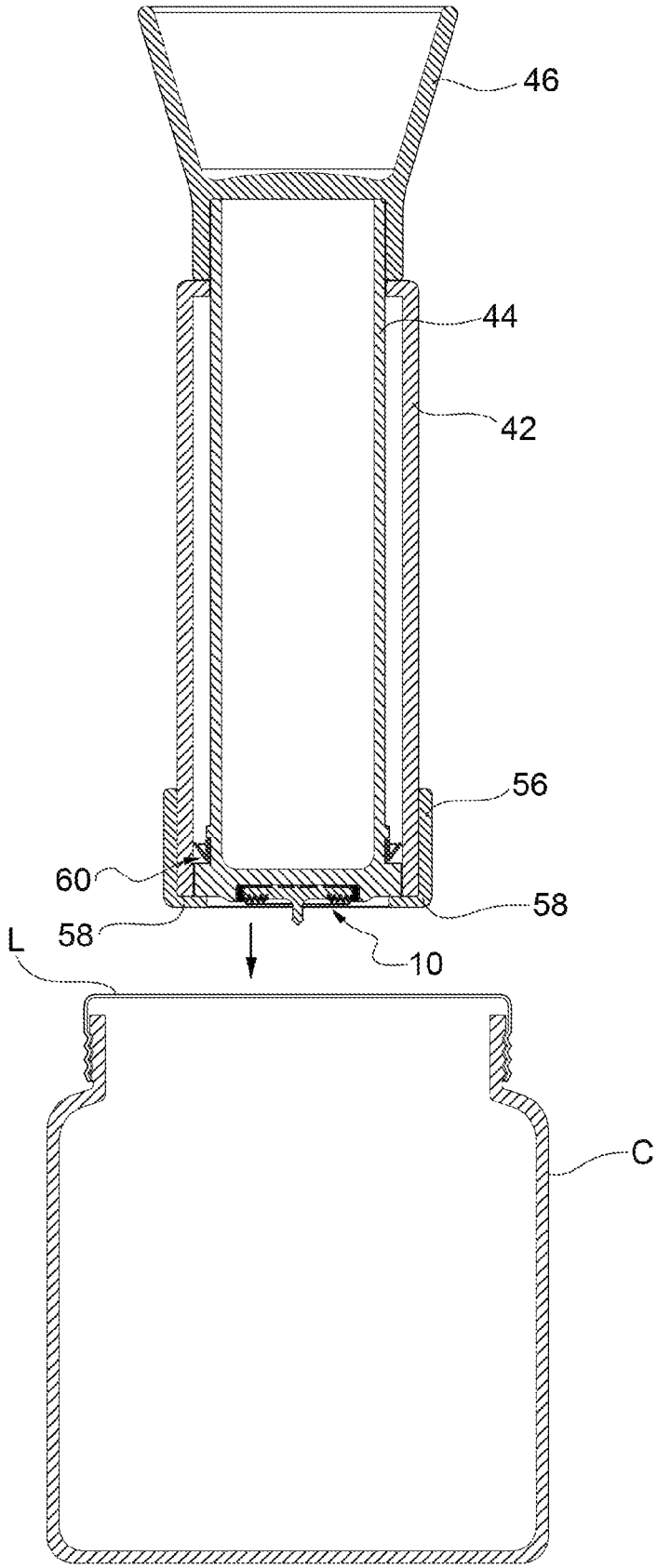
Figure 3E:
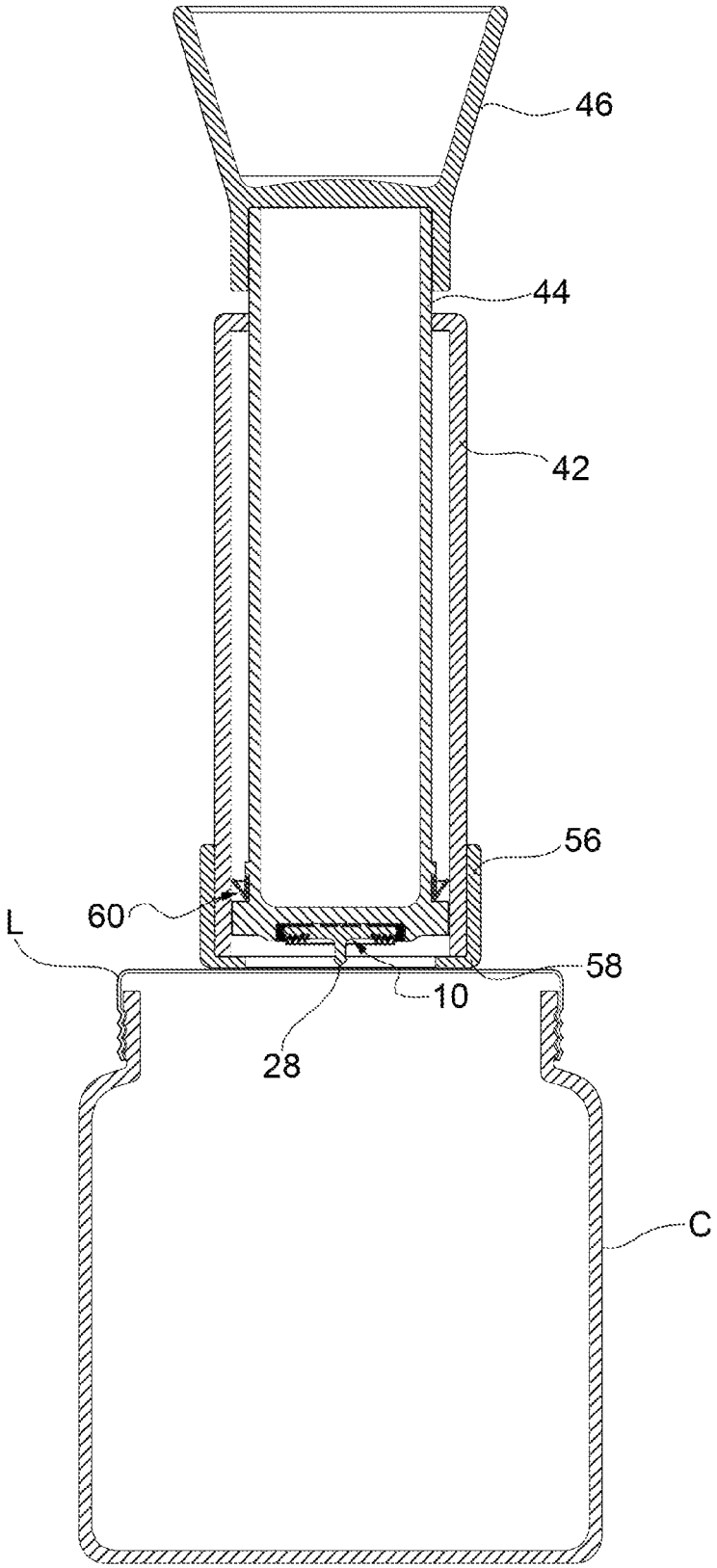
Figure 3F:
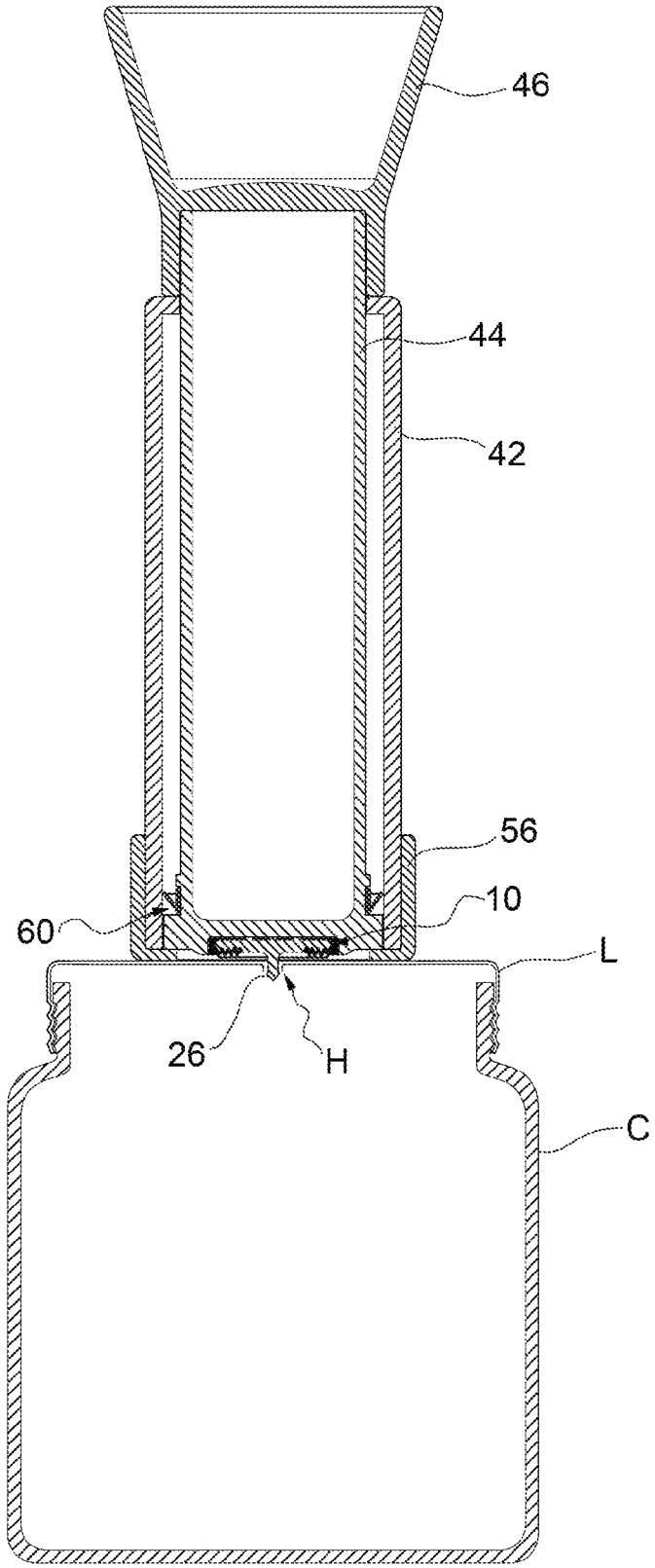

The pump bearing the valve retained in the appropriate housing can be used as a tool for the punching and the consequent driving of the valve into the lid, as represented in the succession of operations illustrated in FIGS. 3*d*-3*f*. The plunger 44 is partially raised and the pump is positioned on the lid, with which it is in contact by means of the support flange 58. Then, by operating on the grip and by imparting a sudden downward movement to the plunger, the valve is guided to pierce the lid with the necessary force, in the correct direction. In this manner, the driving operation of the valve is facilitated with respect to the case in which simple pressure would be exerted on the body of the valve, as difficulties would arise here in firmly gripping the valve and preventing an undesired slipping thereof on the surface of the lid.

In the figures, the hole made by driving the punching member of the valve is indicated with H.

As said above, once the valve is driven into the lid, the valve is stably retained in the seat by virtue of the operation of the spiked formation 24 which, by bringing itself in abutment against the open edge of the hole H, opposes the extraction movement of the punching member.

Figure 3G:
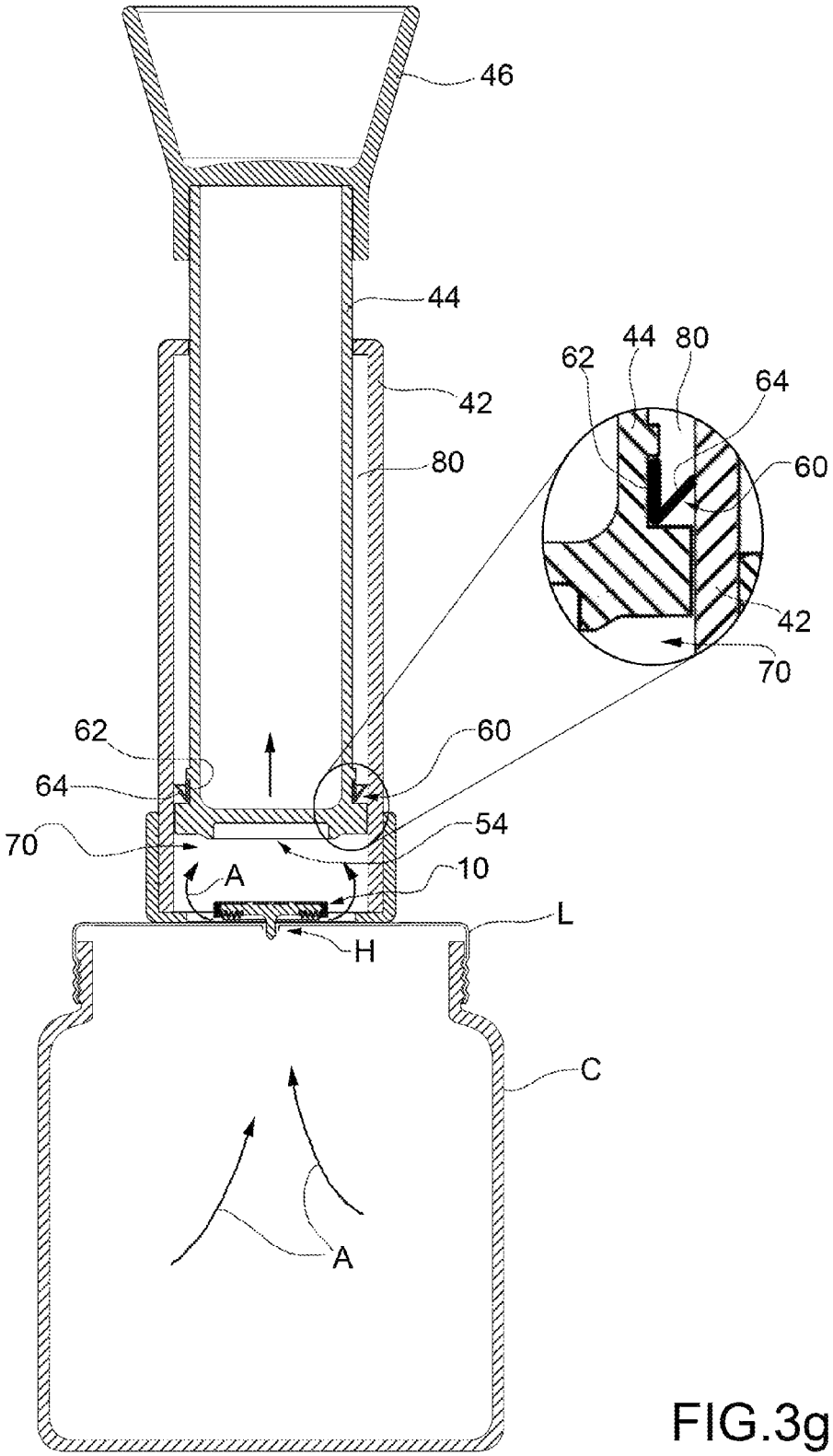
Figure 3H:
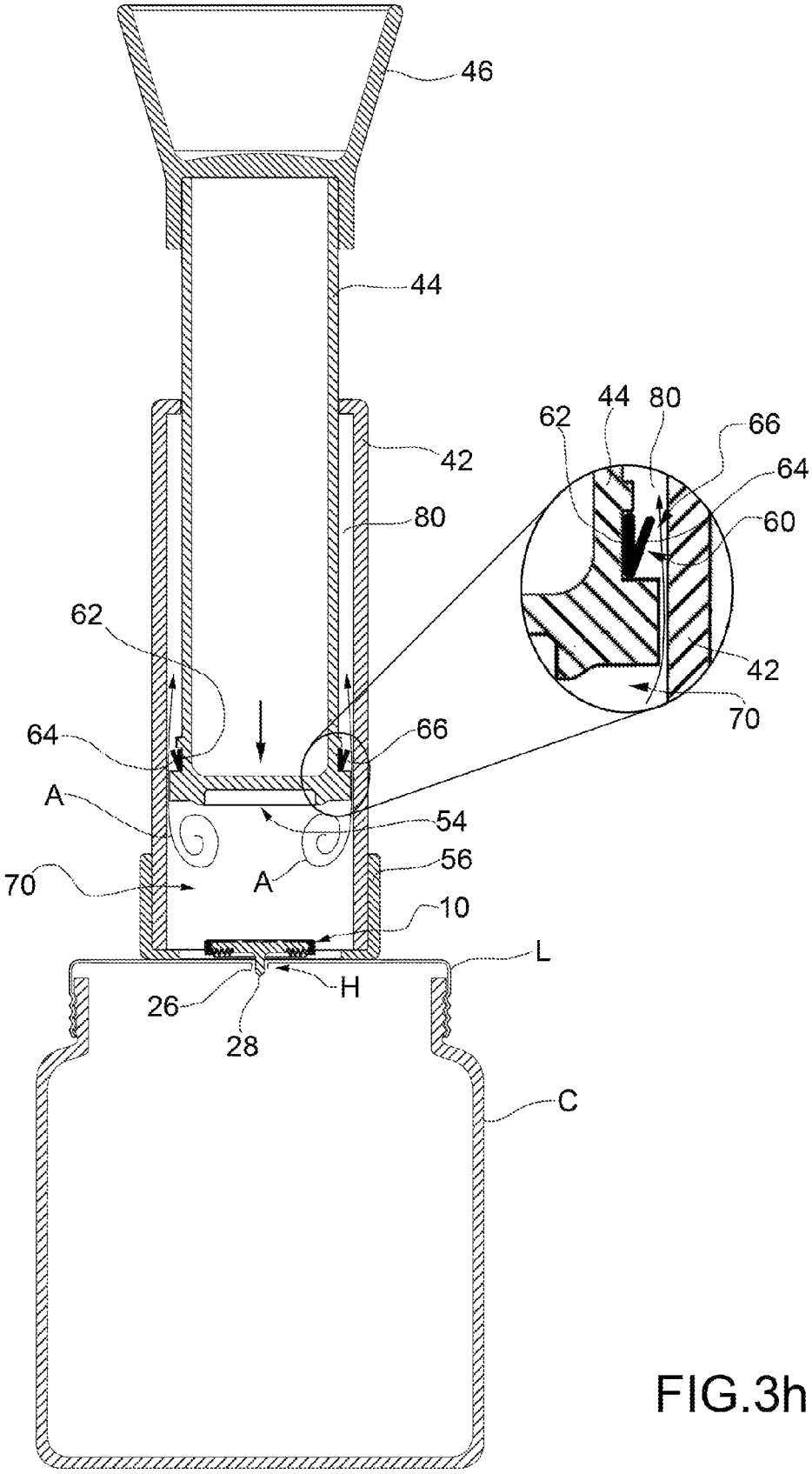

Starting from this condition, an operation for evacuating air from the container can be carried out, if it is necessary to vacuum package the product enclosed therein. The evacuation occurs by alternately actuating the pump between the suction and compression steps, as shown in FIGS. 3*g* and 3*h*.

During suctioning, the plunger 44 is raised from a start position of a suction stroke, in which the base of the plunger is situated flush with the opening at the bottom of the cylinder (such condition attained by the abutment of the plunger on the flange 58 of the support collar and/or by the abutment of the grip portion 46 on the top of the cylinder), up to an end position of the suction stroke, in which the bottom of the plunger defines a suction chamber 70 with the lateral walls inside the cylinder. The movement of the plunger is indicated by the associated arrow, represented in FIG. 3*g*.

In this step, air is suctioned from the container through the evacuation aperture defined between the edge of the evacuation hole H and the stem 22 of the sealing valve. The sealing ring 60 takes up an open position, whereby it prevents any air passage from an upper release gap 80 (defined between the facing walls of the cylinder and the plunger) to the suction chamber 70, which thus only fills with air from the container. The path of the air is identified by the curves A depicted in the container and around the valve, towards the suction chamber.

During compression, the plunger is lowered from a start position of a compression stroke, coinciding with the attained end suction position, to an end position of the compression stroke, in which it is realigned with the bottom of the cylinder, substantially canceling the volume of the suction chamber. The movement of the plunger is indicated by the arrow associated therewith, represented in FIG. 3*h*.

In this step, the sealing ring 60 takes up a contracted position, whereby it allows the passage of air from the suction chamber 70 to the discharge gap 80, and from here the outflow of the air through suitable outflow apertures (not shown). The air path is identified by the curves A depicted between the suction chamber and the discharge gap, through the outflow aperture 66.

The compression of the air in the suction chamber has the effect of exerting a pressure on the closing body of the valve that is greater than the reduced pressure that is created inside the container, so that the closing body is pressed on the lid due to the external atmospheric pressure, closing every possible air return path in the container.

Instead, in a subsequent suction step, the partial raising of the closing body from the lid surface is brought about, and the air evacuation aperture is thus reopened.

The suction and compression maneuvers, in quick succession, allow obtaining significant reduced pressure inside the container with minimal effort and in little time. Such reduced pressure is effective for the extended preservation of foods or other perishable products, such as paints, gunpowder, screws and hardware in general and electronic components, and is advantageous with respect to a simple air-tight sealing closure at ambient atmosphere.

Figure 4A:
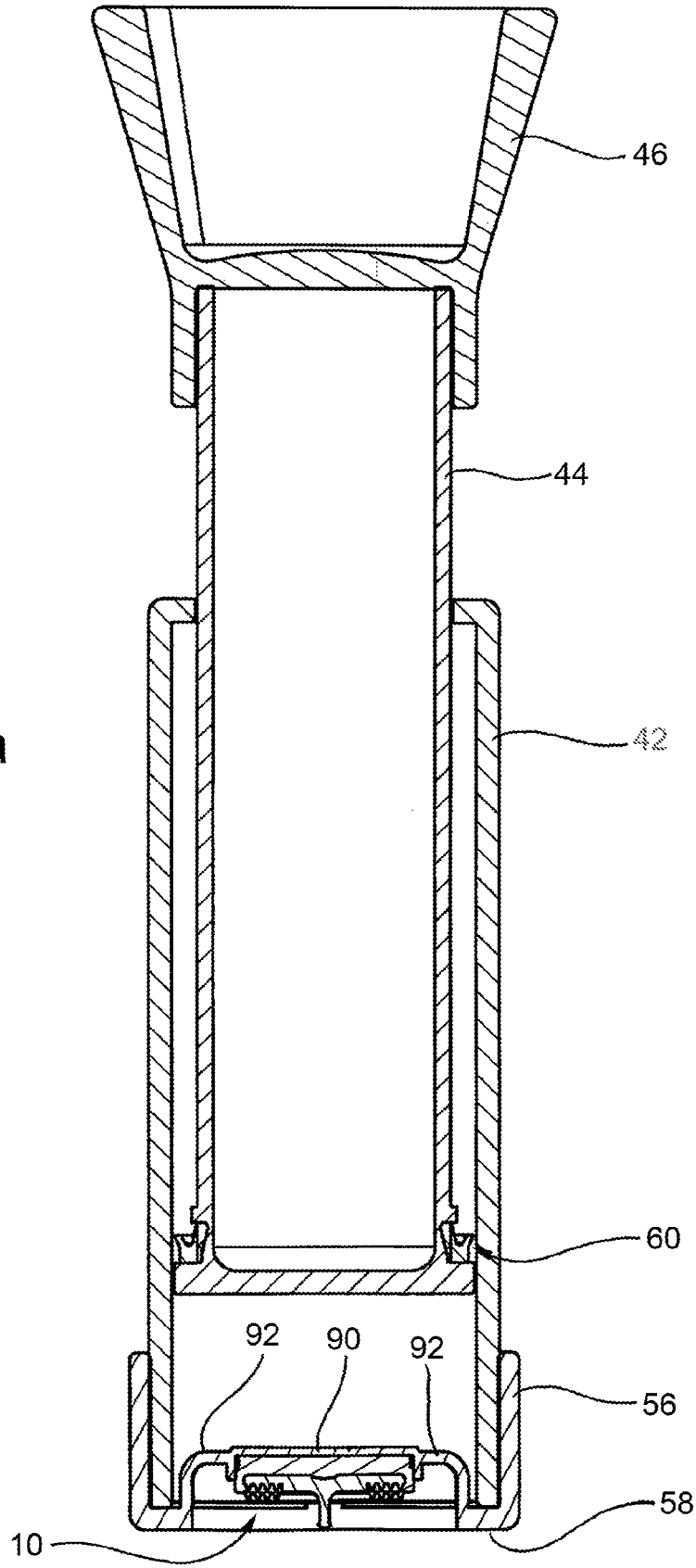
FIGS. 4*a*-4*d* are respectively cross section and perspective views related to a second vacuum pump embodiment for a vacuum packaging system based on the principle of the invention.
Figure 4B:
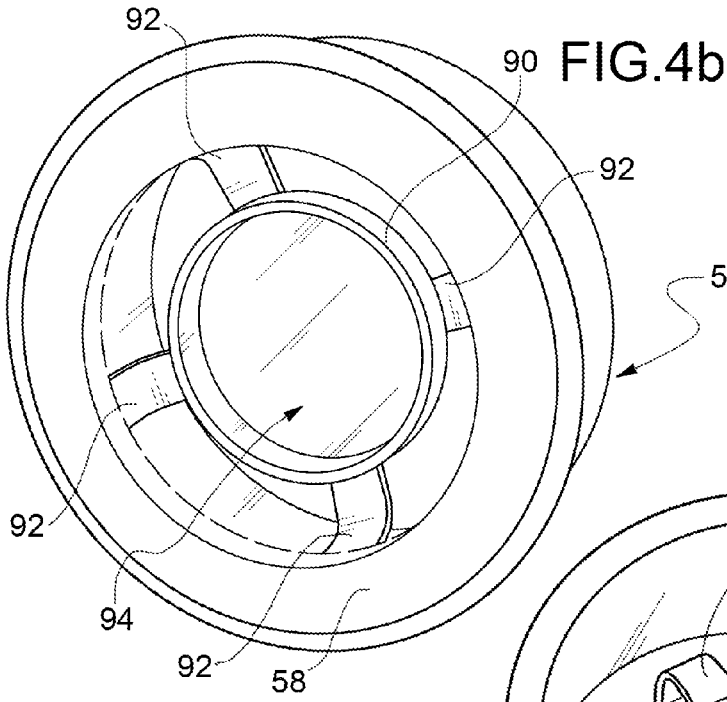
Figure 4C:
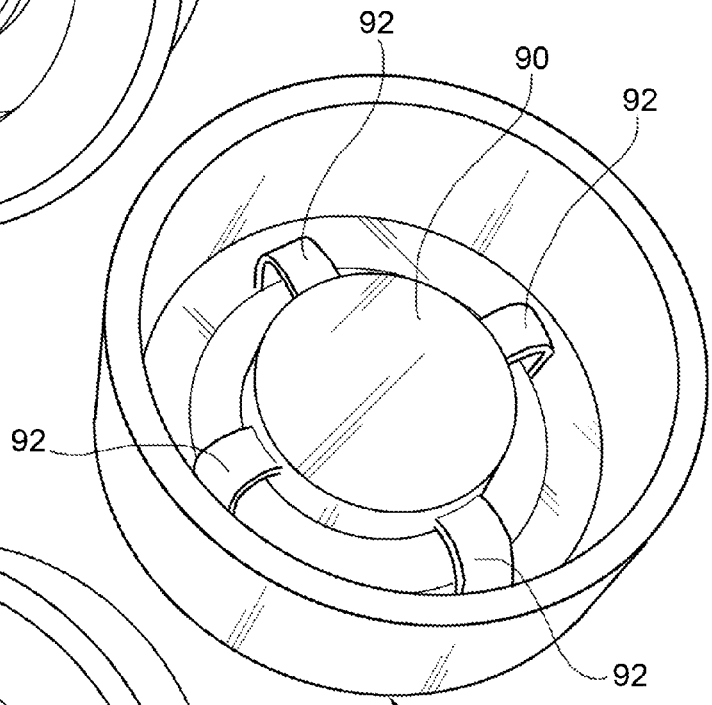
Figure 4D:
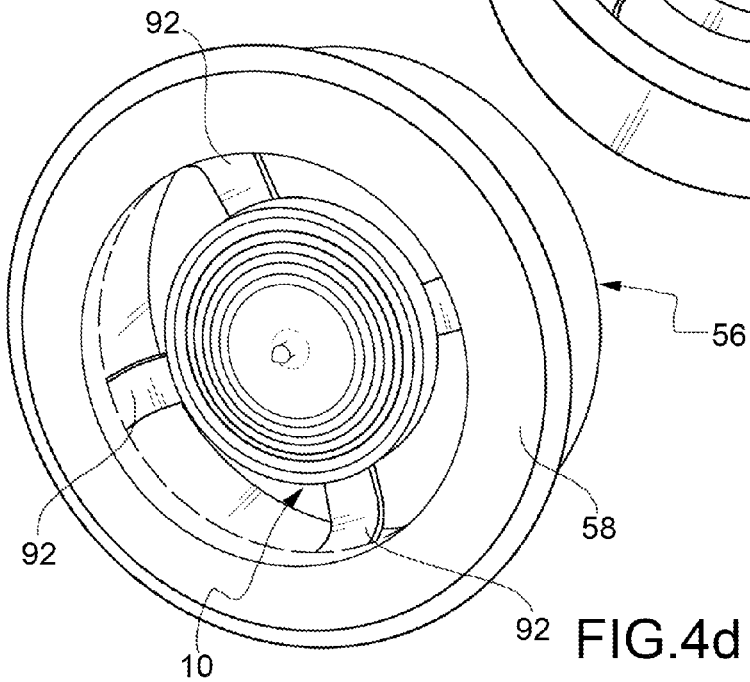

In an alternative embodiment, shown in FIGS. 4*a*-4*d*, the collar 56 at the base of the cylinder 42 has a circular plate 90 at its center, flexibly connected to the support flange 58 of the pump 40 on the lid by means of a plurality of elastic support tongues 92. The plate has a recess 94 with shape and size corresponding to the closing body 12 of the valve, which defines a temporary housing for retaining a valve 10 intended to be driven in a lid. Advantageously, the valve to be driven is retained in its seat via simple friction between the coating 30 of the lateral surface of the valve body 12 and the walls of the recess 94. The FIGS. 4*b* and 4*c* show an enlarged perspective view of the base collar 56, and the FIG. 4*d* shows the collar 56 in a condition retaining a valve.

The plate 90 is situated in a raised position with respect to the support flange 58 of the pump on the lid, due to the L-shaped conformation of the tongues 92, in a manner such that it can house a valve 10 intended to be driven in the lid in contact with the surface of the lid itself when the cylinder 42 of the pump is abutted thereon.

The pump bearing the valve retained in the suitable seat can be used as a tool for the punching and the consequent driving of the valve into the lid, in a substantially analogous manner to that shown in the succession of operations in FIGS. 3*d*-3*f*.

When the pump is positioned on the lid and the plunger 44 is partially raised, the valve is retained in contact with the lid itself through its punching tip. Then, by operating on the grip, and by imparting a sudden downward movement to the plunger, this hits the plate 90 at the end of its stroke. Due to the deformation of the support tongues following the force imparted by the descending plunger, the plate 90 takes on a lowered position, pressing the valve on the lid with the force necessary to pierce it in the correct direction.

Also in this case, the driving operation of the valve is facilitated with respect to the case where simple pressure would be applied on the body of the valve, when difficulties would arise in firmly gripping the valve and preventing an undesired slipping thereof on the lid surface.

Advantageously, in the subsequent air evacuation operations in which the pump is alternately actuated between the suction and compression steps, the start position of the suction stroke has the plunger in abutment on the plate 90 when the latter is situated in a raised rest position, so that the plunger no longer interferes with the valve driven in the lid during its reciprocating motion and the valve is therefore not stressed against the inner surface of the lid. Such stressed condition could—with extended use—cause excessive wear of the spiked formation of the valve or of the edge of the hole on which it is engaged in abutment, with the risk of causing an accidental extraction of the valve from the created seat.

Figure 5A:
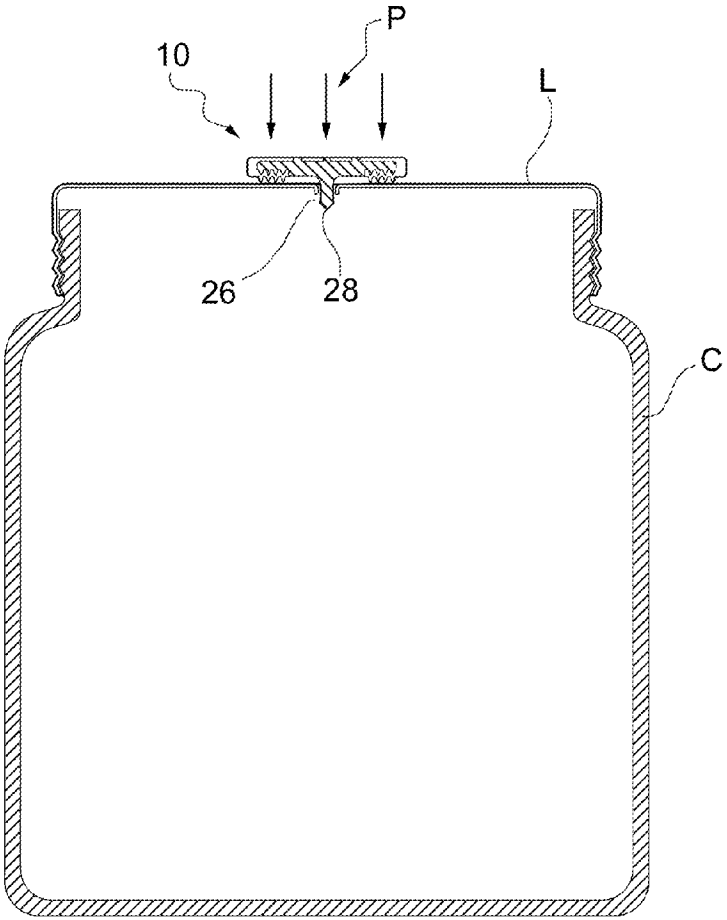
FIGS. 5*a* and 5*b* are exemplifying cross section views of a container with air-tight closure transformed for vacuum packaging in accordance with the invention.
Figure 5B:
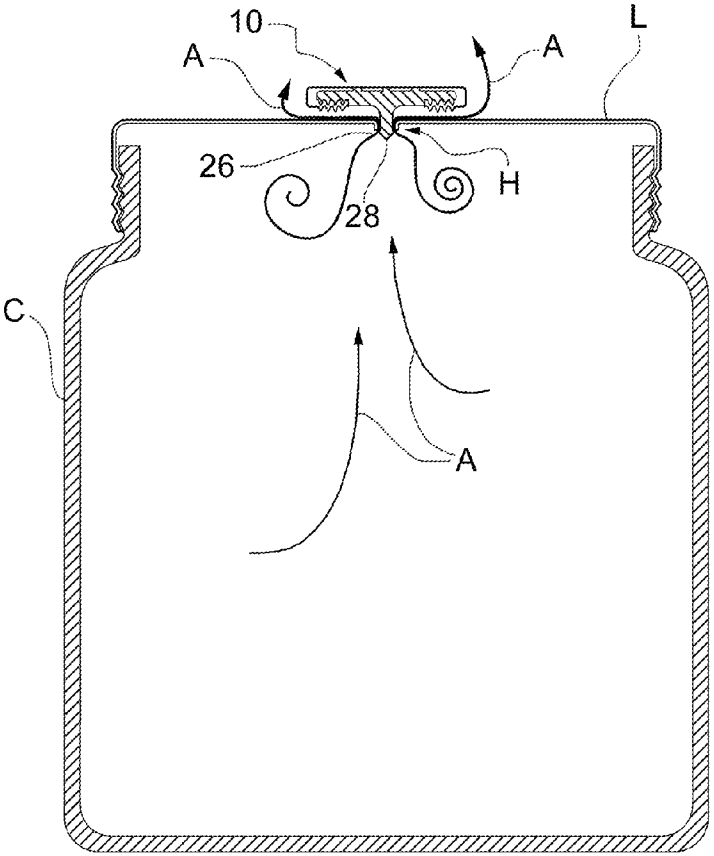
Figure 6D:
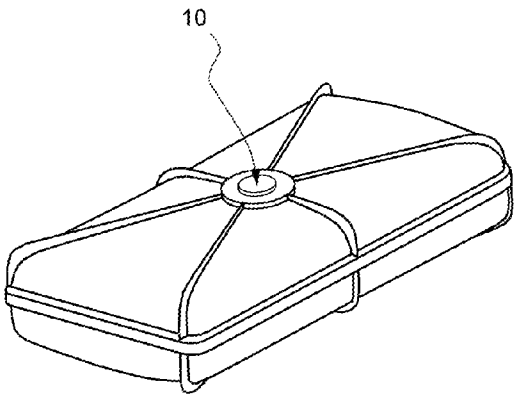
FIGS. 6*a*-6*d* are exemplifying views of different applications of an alternative vacuum packaging system, provided with a sealing valve according to the invention.
Figure 6C:
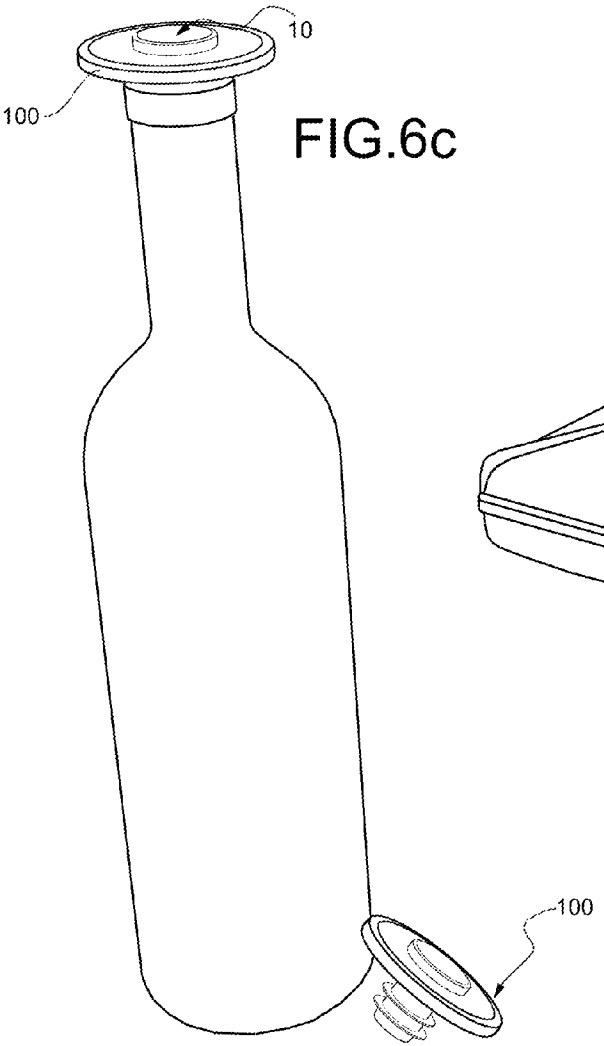
Figure 6B:
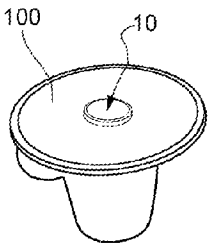
Figure 6A:
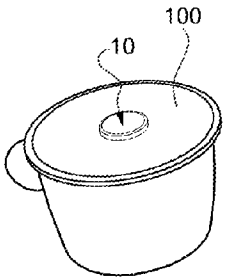

In FIG. 5*a*, a final condition is shown of the vacuum package obtained according to the method described in accordance with the invention. The valve 10 remains stably in contact with the lid L through the coating layer which acts like a gasket, and causes the sealed closure of the air evacuation hole. The pressure difference between the volume inside the container, where reduced pressure has been created, and the external environment causes the rise of a net compression force acting on the container, and particularly on the valve (indicated by the arrows P in the figure), which contributes to maintaining the valve itself in position on the lid.

The operation of a user who, with a tool or simply by hand, operates on the edge of the closing body of the valve, raising it from the lid, will suffice for opening an air inflow channel to the container, due to the pre-existing reduced pressure.

It is observed that, by virtue of the achievement of the punching member in plastic material, unlike with a metal punching tip, after the impact with the sheet metal of the lid and its piercing, the tip of the member is blunted, so that it is not dangerous if a user should inadvertently touch the inner face of the lid, e.g. during washing operations.

Finally, FIGS. 6*a*-6*d* show different applications of a vacuum air-tight closure system for receptacles, provided with a sealing valve according to the present invention.

In the figures, different receptacles are shown which are in any case adapted for vacuum packaging, such as a cup, an espresso cup, a bottle and a tray, the latter conveniently adapted for preserving packed foods.

The valve 10 described above is previously coupled to a lid with disc shape 100, whose surface intended to be at least partially turned towards the receptacle interior is coated with a deformable food-grade plastic material, such as laprene, silicone, . . . , adapted to form a gasket for the air-tight closure of the receptacle in cooperation with the edge of the mouth.

The receptacle can be any container having a regular mouth, i.e. which lies entirely on a horizontal plane, and the lid 100 is simply set thereon. The creation of reduced pressure inside the receptacle achieves the effect of further retaining the lid in position. Naturally, in the case of receptacles such as bottles, flasks or the like, which have a mouth at the end of a long and narrow neck, the lid can be substituted with a plug that can have a coat adapted for being externally fit or introduced into the bottle neck interior, both made of deformable plastic material and adapted to form a sealing gasket with the mouth of the container.

Of course, without detriment to the principle of the invention, the embodiments and embodiment details can be widely varied with respect to that described and illustrated above as a merely non-limiting example, without departing from the protective scope of the invention defined by the attached claims.

What is claimed is:

1. A vacuum sealing valve applied to a lid for the air-tight closing of a container for the packaging of products, comprising:

a closing body sealing an air evacuating hole for evacuating air from the container, a punching member stemming from said closing body and formed integrally with said closing body, said punching member having a stem and a widened punching head projecting transversely to the stem and terminating in a sharp tip piercing the lid closing the container to form said evacuating hole, said evacuating hole having dimensions substantially corresponding to said tip of said punching member;

wherein the closing body comprising a deformable material shaped to form a frontal gasket and a ridge extending along a closed path around said punching member.

2. The valve according to claim 1, said punching head defining a spiked formation adapted to engage an edge of the evacuating hole in an assembled condition to prevent complete extraction of the valve from said evacuating hole.

3. The valve according to claim 1, wherein the closing body is provided with a perimeter coating made of a material having a high elastic deformation coefficient and a high pneumatic seal.

4. A vacuum pump for evacuating air from a container arranged for vacuum packaging of products, comprising:

a plunger slidable with a reciprocating motion into a suction cylinder suitable to be coupled to the container at a base in correspondence to an air evacuating hole for evacuating air from the container, the air evacuating hole being closable by a vacuum sealing valve, wherein the base of the pump has a recess having a shape and size corresponding to the body of a vacuum sealing valve applied to a lid of the container, to form a housing for retaining the valve, wherein lowering of the plunger allows driving the valve in the lid of said container; the vacuum sealing valve including a closing body sealing the air evacuating hole, and a punching member stemming from and formed integrally with said closing body, said punching member having a sharp tip piercing the lid closing the container to form said evacuating hole, said evacuating hole having dimensions substantially corresponding to dimensions of said tip of said punching member.

5. The pump according to claim 4, wherein said recess is made at the base of the plunger.

6. The pump according to claim 4, wherein said recess is made at the base of the cylinder in a raised position with respect to a support formation of the pump on the lid, and attains a lowered position following the lowering movement of the plunger.

7. The pump according to claim 4, adapted to perform suction of air present within the container, and compression of the suctioned air and its subsequent release of the air to the external environment, comprising a resiliently deformable V-shaped sealing ring, arranged between an inner wall of the cylinder and an outer wall of the plunger, having an inner lip fixed to said outer wall of the plunger, and a flexible outer lip, adapted to take up an open position in contact with said inner wall of the cylinder in a suction step, and a contracted position, closer to the inner lip, which brings about the opening of a circumferential outflow aperture between the ring and the inner wall of the cylinder, in a discharge step.

8. The pump according to claim 4, wherein the plunger has a hollow cylindrical body, whose inner cavity forms a space for storing a stock of valves.

9. The pump according to claim 4, wherein the closing body comprising a deformable material shaped to form a frontal gasket and a ridge extending along a closed path around said punching member.

10. The pump according to claim 4, said punching member having a stem and a widened punching head projecting transversely to the stem and terminating in the sharp tip.

* * * * *